US009234473B2

(12) United States Patent
Sekiguchi et al.

(10) Patent No.: US 9,234,473 B2
(45) Date of Patent: Jan. 12, 2016

(54) AIR-FUEL RATIO CONTROL APPARATUS FOR INTERNAL COMBUSTION ENGINE

(71) Applicant: HONDA MOTOR CO., LTD., Tokyo (JP)

(72) Inventors: Tooru Sekiguchi, Wako (JP); Atsuhiro Miyauchi, Wako (JP); Takeshi Aoki, Wako (JP); Seiji Watanabe, Wako (JP); Kazunori Kawamura, Wako (JP); Michinori Tani, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 694 days.

(21) Appl. No.: 13/666,973

(22) Filed: Nov. 2, 2012

(65) Prior Publication Data

US 2013/0131962 A1 May 23, 2013

(30) Foreign Application Priority Data

Nov. 22, 2011 (JP) ..... 2011-255459

(51) Int. Cl.
*F02D 41/00* (2006.01)
*F02D 41/14* (2006.01)
*F02D 41/28* (2006.01)

(52) U.S. Cl.
CPC ..... *F02D 41/0085* (2013.01); *F02D 41/1456* (2013.01); *F02D 41/1495* (2013.01); *F02D 2041/288* (2013.01)

(58) Field of Classification Search
CPC ..... F02D 41/0085; F02D 41/1456; F02D 41/1495; F02D 2041/288
See application file for complete search history.

(56) References Cited

U.S. PATENT DOCUMENTS 5,915,368 A * 6/1999 Ishida ..... F02D 41/047 126/675
7,146,851 B2 * 12/2006 Wakahara ..... F01L 1/34 73/114.72
7,802,563 B2 * 9/2010 Behr ..... F02D 41/0082 123/692
2005/0161032 A1 * 7/2005 Nakagawa ..... F02D 41/1495 123/673
2009/0037079 A1 * 2/2009 Suzuki ..... F02D 41/008 701/103
2011/0219861 A1 * 9/2011 Kayama ..... F02D 41/22 73/114.72

FOREIGN PATENT DOCUMENTS

JP 2000-220489 8/2000

* cited by examiner

*Primary Examiner* — Hieu T Vo
*Assistant Examiner* — Sherman Manley
(74) *Attorney, Agent, or Firm* — Mori & Ward, LLP

(57) ABSTRACT

An air-fuel ratio control apparatus for an internal combustion engine includes an air-fuel ratio detector, a fuel amount controller, an operational state parameter acquiring device, an extractor, a failure determination device, a variation state parameter calculator, and a determination stopping device. The operational state parameter acquiring device is configured to acquire at least one operational state parameter. The failure determination device is configured to execute failure determination of determining a failure in an air-fuel ratio control system of the internal combustion engine based on a specific frequency component extracted by the extractor. The variation state parameter calculator is configured to calculate a variation state parameter. The determination stopping device is configured to stop the failure determination if the variation state parameter calculated by the variation state parameter calculator is equal to or larger than a predetermined threshold value.

20 Claims, 13 Drawing Sheets

BACKGROUND ART

AIR-FUEL RATIO CONTROL APPARATUS FOR INTERNAL COMBUSTION ENGINE

CROSS-REFERENCE TO RELATED APPLICATIONS

The present application claims priority under 35 U.S.C. §119 to Japanese Patent Application No. 2011-255459, filed Nov. 22, 2011, entitled "Air-fuel Ratio Control Apparatus For Internal Combustion Engine." The contents of this application are incorporated herein by reference in their entirety.

BACKGROUND OF THE INVENTION

1. Field of the Invention

The disclosure relates to an air-fuel ratio control apparatus for an internal combustion engine.

2. Discussion of the Background

Japanese Unexamined Patent Application Publication No. 2000-220489 discloses a control apparatus that determines a variation in air-fuel ratio of each cylinder using a single air-fuel ratio sensor provided in the pipes-assembled portion of an exhaust manifold of an internal combustion engine having a plurality of cylinders. This control apparatus acquires data to be used in the determination when a predetermined condition including the amount of a change in the intake air flow rate being smaller than a predetermined amount, the intake air flow rate lying within the range of predetermined upper and lower limits, and the amount of a change in engine speed being smaller than a predetermined amount is fulfilled.

Further, the control apparatus calculates the intensity (MPOW1) of a one-cycle frequency component (frequency component equivalent to a half of a frequency corresponding to the engine speed) which is calculated based on the acquired data, and determines that the air-fuel ratio for each cylinder is varying beyond an allowable limit, when the intensity of the frequency component is equal to or larger than a threshold value (THMP1).

The control apparatus according to the related art executes the determination which uses the amount of a change in an operational state parameter XOP (intake air flow rate, engine speed) of the engine by comparing the amount of a change DXOP for a constant time DT (e.g., 100 msec) with a predetermined amount DXOPTH. Even in case of an operational state where there is a significant change in a period of 300 msec or so, for example, data acquisition is permitted when the change DXOP is equal to or smaller than the predetermined amount DXOPTH (see FIG. 14A). Further, even when the operational state parameter XOP has varied significantly, data acquisition is permitted when the variation lies within the range of predetermined upper and lower limits XOPLMH and XOPLML (see FIG. 14B).

SUMMARY OF THE INVENTION

According to one aspect of the present invention, an air-fuel ratio control apparatus for an internal combustion engine includes an air-fuel ratio detector, a fuel amount controller, an operational state parameter acquiring device, an extractor, a failure determination device, a variation state parameter calculator, and a determination stopping device. The air-fuel ratio detector is configured to detect an air-fuel ratio in an exhaust passage provided in the internal combustion engine including a plurality of cylinders. The fuel amount controller configured to control an amount of fuel to be supplied to each of the plurality of cylinders. The operational state parameter acquiring device is configured to acquire at least one operational state parameter representing an operational state of the internal combustion engine. The extractor is configured to extract a specific frequency component from a detection signal output from the air-fuel ratio detector during a failure determination period. The failure determination device is configured to execute failure determination of determining a failure in an air-fuel ratio control system of the internal combustion engine based on the specific frequency component extracted by the extractor. The variation state parameter calculator is configured to calculate a variation state parameter representing a state of a variation in the operational state parameter after initiation of the failure determination period. The variation state parameter reflects a variational history of the operational state parameter. The determination stopping device is configured to stop the failure determination if the variation state parameter calculated by the variation state parameter calculator is equal to or larger than a predetermined threshold value.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
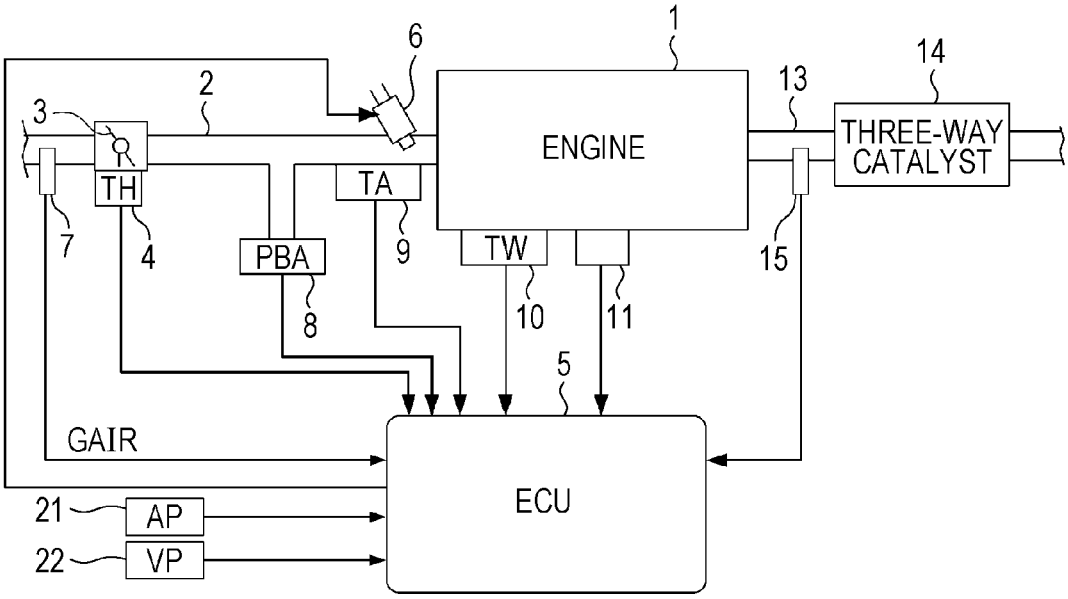
FIG. 1 is a diagram showing the configuration of an internal combustion engine and an air-fuel ratio control apparatus therefor according to an exemplary embodiment of the disclosure.

The embodiments will now be described with reference to the accompanying drawings, wherein like reference numerals designate corresponding or identical elements throughout the various drawings.

First Embodiment

FIG. 1 is a diagram showing the general configuration of an internal combustion engine (hereinafter referred to as "engine") 1 and an air-fuel ratio control apparatus therefor according to an exemplary embodiment of the disclosure. A throttle valve 3 is disposed in an intake pipe 2 of the engine 1 of, for example, a four-cylinder type. A throttle valve opening degree sensor 4 which detects a throttle valve opening angle TH is coupled to the throttle valve 3. A detection signal from the throttle valve opening degree sensor 4 is supplied to an electronic control unit (hereinafter referred to as "ECU") 5.

A fuel injection valve 6 is provided between the engine 1 and the throttle valve 3 and slightly upstream of an intake valve (not shown) in the intake pipe 2. The individual fuel injection valves 6 are connected to a fuel pump (not shown), and are electrically connected to the ECU 5, so that the open times of the fuel injection valves 6 are controlled by signals from the ECU 5.

An intake air flow rate sensor 7 which detects an intake air flow rate GAIR is provided upstream of the throttle valve 3. A suction pressure sensor 8 which detects a suction pressure PBA, and a suction temperature sensor 9 which detects a suction temperature TA are provided downstream of the throttle valve 3. Detection signals from those sensors are supplied to the ECU 5. A coolant temperature sensor 10 which detects an engine coolant temperature TW is mounted on the body of the engine 1, and a detection signal from the coolant temperature sensor 10 is supplied to the ECU 5.

The ECU 5 is connected with a crank angle position sensor 11 which detects the rotational angle of the crank shaft (not shown) of the engine 1, so that a signal according to the rotational angle of the crank shaft is supplied to the ECU 5. The crank angle position sensor 11 includes a cylinder discrimination sensor which outputs a pulse at a predetermined crank angle position of a certain cylinder of the engine 1 (hereinafter referred to as "CYL pulse"), a TDC sensor which outputs a TDC pulse at a crank angle position (every crank angle of 180 degrees in a four-cylinder engine) before a predetermined crank angle with regard to a top dead center (TDC) when the suction stroke of each cylinder starts, and a CRK sensor which generates one pulse (hereinafter referred to as "CRK pulse"), shorter than the TDC pulse, at a constant crank angle period (e.g., period of 6 degrees). The CYL pulse, the TDC pulse and the CRK pulse are supplied to the ECU 5. Those pulses are used in controlling various timings such as fuel injection timing and ignition timing, and detecting the number of engine rotations (engine speed) NE.

A three-way catalyst 14 is provided in an exhaust passage 13. The three-way catalyst 14 is capable of storing oxygen. The three-way catalyst 14 stores oxygen in the emission in an exhaust lean state where the air-fuel ratio of the air-fuel mixture supplied to the engine 1 is set leaner than the theoretical air-fuel ratio so that the oxygen concentration in the emission is relatively high. In an exhaust rich state where the air-fuel ratio of the air-fuel mixture supplied to the engine 1 is set richer than the theoretical air-fuel ratio so that the oxygen concentration in the emission is low and the amounts of HC and CO components in the emission are large, on the other hand, the three-way catalyst 14 is capable of oxidizing the HC and CO components in the emission with the stored oxygen.

A proportional oxygen concentration sensor (hereinafter referred to as "LAF sensor") 15 is mounted upstream of the three-way catalyst 14 and downstream of the collected portion of an exhaust manifold connecting to the individual cylinders. The LAF sensor 15 produces a detection signal substantially proportional to the oxygen concentration (air-fuel ratio) in the emission, and supplies the detection signal to the ECU 5.

The ECU 5 is connected with an accelerator sensor 21 which detects the depression amount, AP, of the accelerator pedal of the vehicle driven by the engine 1 (hereinafter referred to as "accelerator pedal depression amount"), and a vehicle speed sensor 22 which detects a running speed (vehicle speed) VP of the vehicle. Detection signals from these sensors are supplied to the ECU 5. The throttle valve 3 is actuated to be opened or closed by an actuator (not shown), and the throttle valve opening angle TH is controlled according to the accelerator pedal depression amount AP by the ECU 5.

The engine 1 is provided with a well-known emission circulation mechanism though not illustrated.

The ECU 5 includes an input circuit having various functions of, for example, shaping input signal waveforms from various sensors, correcting a voltage level to a predetermined level, and converting an analog signal value to a digital signal value, a central processing unit (hereinafter referred to as "CPU"), a memory circuit which stores various operation programs to be executed by the CPU, operation results, etc., and an output circuit which supplies a drive signal to the fuel injection valves 6.

The CPU of the ECU 5 discriminates various engine operational states based on the detection signals from the aforementioned various sensors, and calculates a fuel injection time TOUT of each fuel injection valve 6 which is actuated to be open in synchronism with the TDC pulse, in accordance with the discriminated engine operational state using the following equation 1. Because the fuel injection time TOUT is substantially proportional to the amount of fuel injected, it is hereinafter called "fuel injection amount TOUT".

$$TOUT = TIM \times KCMD \times KAF \times KTOTAL \quad (1)$$

In the equation 1, TIM is a basic fuel amount, specifically the basic fuel injection time of the fuel injection valve 6, and is determined searching a TIM table set according to the intake air flow rate GAIR. The TIM table is set so that the air-fuel ratio A/F of the air-fuel mixture to be combusted in the engine 1 substantially becomes the theoretical air-fuel ratio.

In the equation 1, KCMD is a target air-fuel ratio coefficient set according to the operational state of the engine 1. Because the target air-fuel ratio coefficient KCMD is proportional to the reciprocal of the air-fuel ratio A/F, i.e, a fuel-air ratio F/A, target and takes a value of 1.0 in case of the theoretical air-fuel ratio, the target air-fuel ratio coefficient is hereinafter referred to as "equivalence ratio". As will be described later, the target equivalence ratio KCMD is set in such a way that the target equivalence ratio KCMD changes sinusoidally in a range of 1.0±DAF with elapse of time when determining a failure originated from the deterioration of the response characteristic of the LAF sensor 15.

In the equation 1, KAF is an air-fuel ratio correction coefficient which is calculated by adaptive control using PID (Proportional Integral and Differential) control or a self tuning regulator in such a way that a detection equivalence ratio KACT calculated from the value detected by the LAF sensor 15 matches with the target equivalence ratio KCMD when a condition for executing air-fuel ratio feedback control is satisfied.

In the equation 1, KTOTAL is a product of other correction coefficients (correction coefficient KTW according to the engine coolant temperature TW, correction coefficient KTA according to the suction temperature TA, etc.) to be calculated according to various engine parameter signals.

The CPU of the ECU 5 supplies the drive signal to open the fuel injection valves 6 to the fuel injection valves 6 via the output circuit based on the fuel injection amount TOUT obtained in the above-described manner. The CPU of the ECU 5 also determines a failure originated from the deterioration of the response characteristic of the LAF sensor 15 in a way described below.

The determination of a failure originated from the deterioration of the response characteristic according to the embodiment is identical to the scheme disclosed in, for example, Japanese Unexamined Patent Application Publication No. 2010-101289, the entire contents of which are incorporated herein by reference. According to this determination scheme, air-fuel ratio oscillation control to oscillate the air-fuel ratio at a frequency f1 while the engine 1 is running is executed, and a failure originated from the deterioration of the response characteristic is determined using a frequency f1 component intensity MPTf1 included in the detection equivalence ratio KACT which is calculated from the output signal of the LAF sensor 15, and a frequency f2 component intensity MPTf2 corresponding to a frequency f2 which is double the frequency f1.

Figure 2:
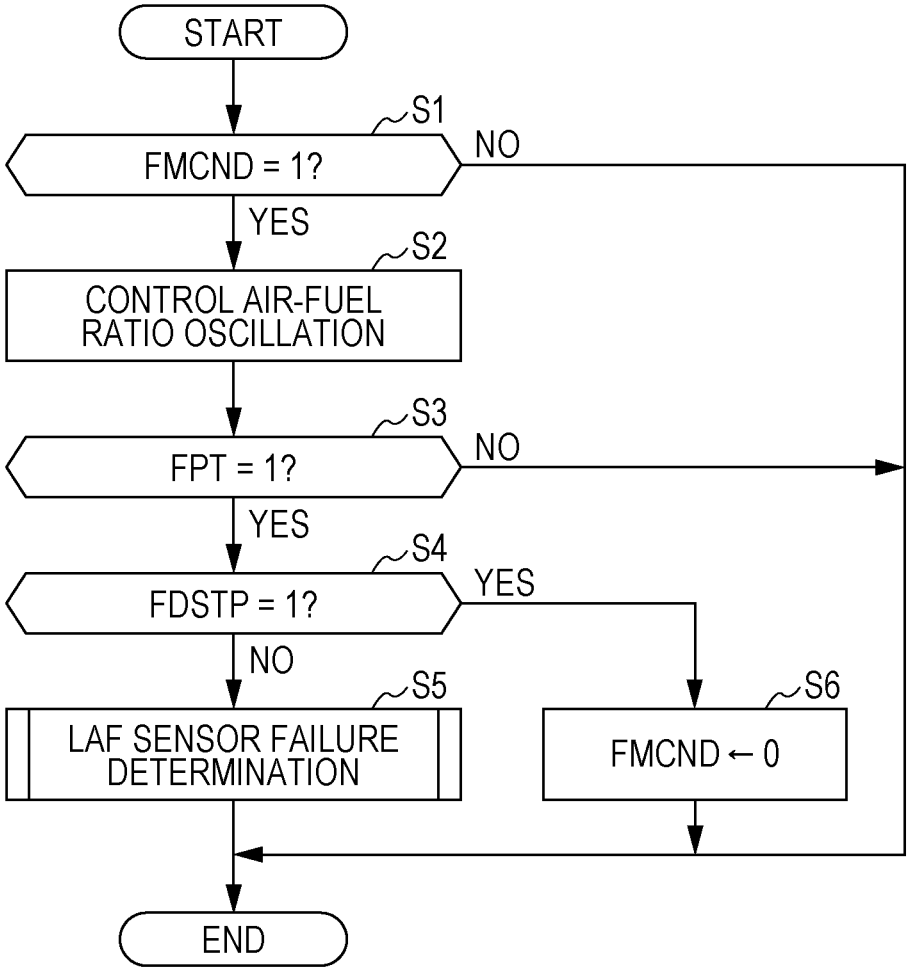
FIG. 2 is a flowchart illustrating the general structure of a failure determination routine.

FIG. 2 is a flowchart illustrating the general structure of the failure determination routine. This routine is executed every predetermined crank angle CACAL (e.g., 30 degrees) by the CPU of the ECU 5.

It is determined in step S11 whether an execution condition flag FMCND is "1". The execution condition flag FMCND is set to "1" when the execution condition for the failure determination in an execution condition determining routine (not shown) is fulfilled. Specifically, the execution condition flag FMCND is set to "1" when the following conditions 1 to 11 are all fulfilled. When any one of the conditions 1 to 11 is not fulfilled, the execution condition flag FMCND is held at "0".

1) The engine speed NE lies within the range of predetermined upper and lower limits.

2) The suction pressure PBA is higher than a predetermined pressure (exhaust flow rate needed for the decision is secured).

3) The LAF sensor 15 is activated.

4) Air-fuel ratio feedback control according to the output of the LAF sensor 15 is executed.

5) The engine coolant temperature TW is higher than a predetermined temperature.

6) A change DNE in engine speed NE per unit time is smaller than a predetermined change in engine speed.

7) A change DPBAF in suction pressure PBA per unit time is smaller than a predetermined change in suction pressure.

8) An accelerated increase in fuel (which is executed upon rapid acceleration) is not carried out.

9) An emission circulation rate is greater than a predetermined value.

10) The LAF-sensor output is not fixed to the upper limit or the lower limit.

11) The response characteristic of the LAF sensor is normal (it is not decided that a failure originated from deterioration of the response characteristic has occurred).

When the execution condition flag FMCND is "0" in step S1, the routine is terminated immediately. When the execution condition flag FMCND is set to "1", the routine proceeds from step S1 to step S2 to execute the air-fuel ratio control to oscillate the target equivalence ratio KCMD according to the following equation 2. During the air-fuel ratio control, the air-fuel ratio correction coefficient KAF is fixed to "1.0" or a specific value other than "1.0". In the equation 2, "Kf1" is a first frequency coefficient which is set to "0.4", for example, when the oscillation frequency f1 is 0.4fNE (fNE=NE (rpm)/60), and "k" is a discretization time at which discretization is effected at the calculation period CACAL of the target equivalence ratio KCMD.

$$KCMD=DAF\times\sin(Kf1\times CACAL\times k)+1 \quad (2)$$

It is determined in step S3 whether an air-fuel ratio oscillation control flag FPT is "1". The air-fuel ratio oscillation control flag FPT is set to "1" when a predetermined stabilization time TSTBL elapses from the time of initiation of the air-fuel ratio oscillation control. When the decision in step S3 is negative (NO), the routine is terminated immediately.

Figure 5:
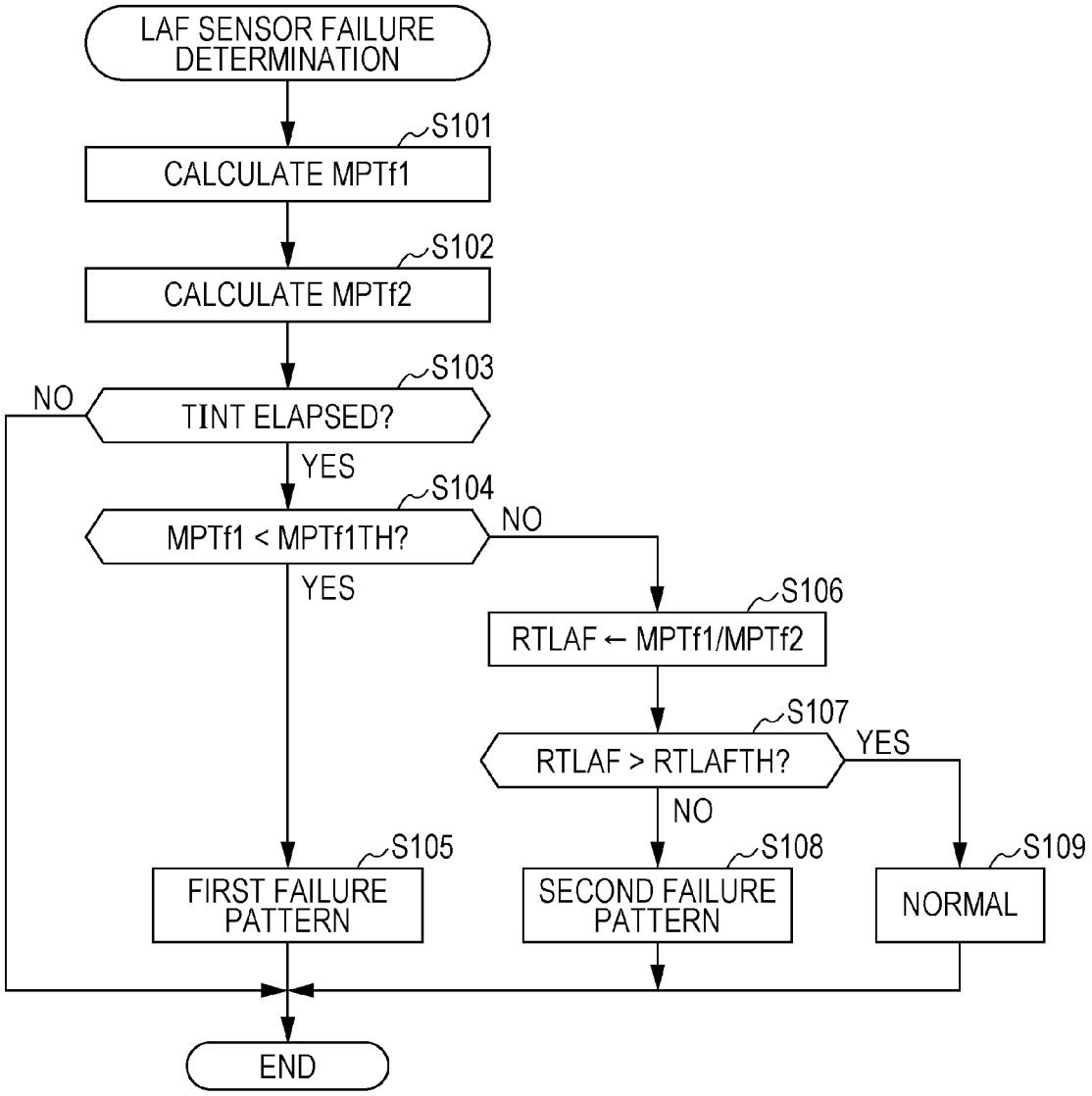
FIG. 5 is a flowchart of an LAF sensor failure determination routine which is executed in the routine of FIG. 2.

When the decision in step S3 is affirmative (YES), it is determined whether a stop condition flag FDSTP is "1" (step S4). The stop condition flag FDSTP is set to "1" when the condition to stop the failure determination routine is fulfilled in the stop condition determination routine illustrated in FIG. 3. When the decision in step S4 is negative (NO), the LAF sensor failure determination routine illustrated in FIG. 5 is executed (step S5).

When FDSTP=1 in step S4, the execution condition flag FMCND is set back to "0" (step S6), after which the routine is terminated.

Figure 3:
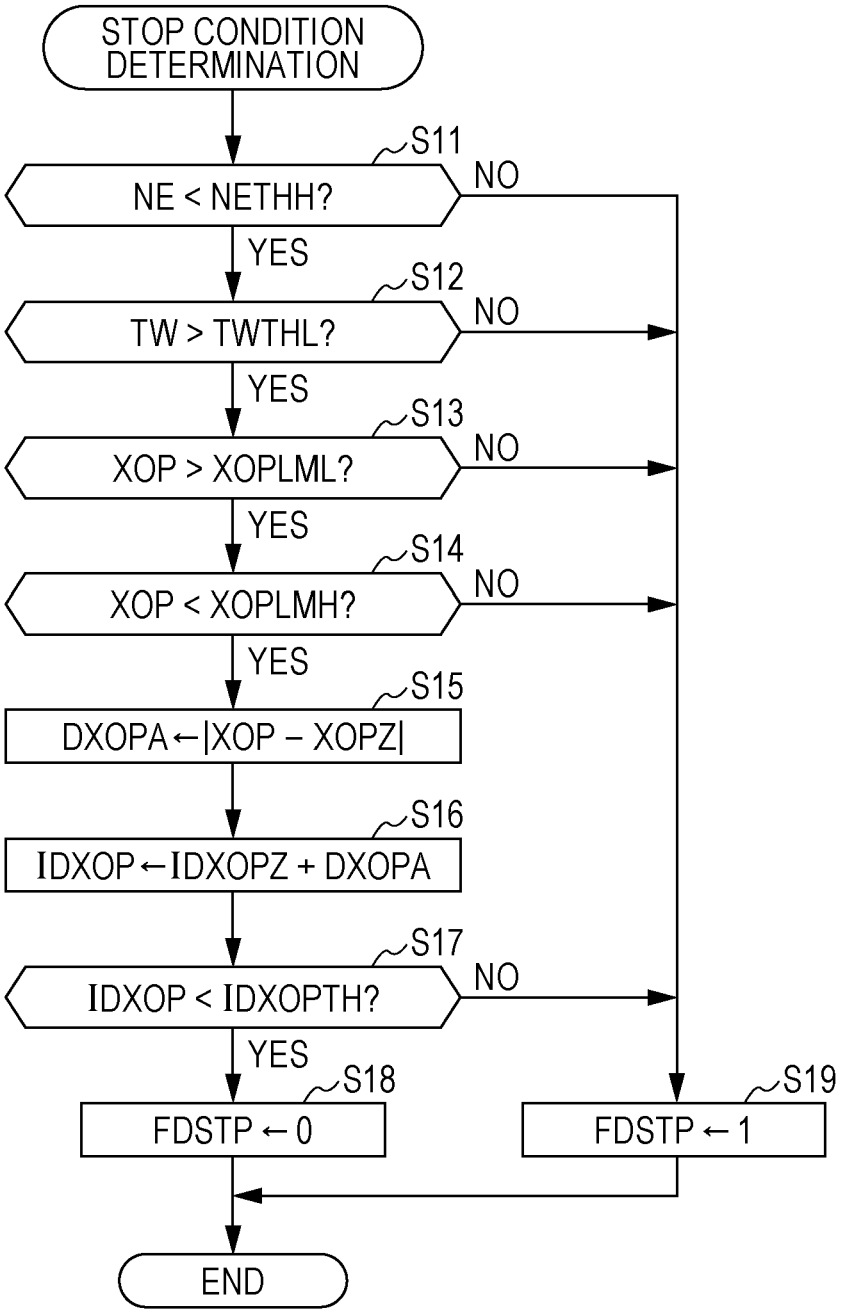
FIG. 3 is a flowchart of a stop condition determination routine (first embodiment).

FIG. 3 is a flowchart of the stop condition determination routine. This routine is executed every predetermined time (e.g., 100 msec) by the CPU of the ECU 5 when the execution condition flag FMCND is "1".

In step S11, it is determined whether the engine speed NE is equal to or lower than a predetermined high speed NETHH. When the decision in step S11 is affirmative (YES), it is determined whether the engine coolant temperature TW is equal to or higher than a predetermined low coolant temperature TWTHL (step S12). When the decision in step S11 or step S12 is negative (NO), it is determined that the failure determination should be stopped, so that the stop condition flag FDSTP is set to "1". It is to be noted however that the predetermined high speed NETHH is set equal to or higher than the upper engine speed in the failure determination execution condition (1), and the predetermined low coolant temperature TWTHL is set equal to or lower than the predetermined temperature in the failure determination execution condition (5). When the predetermined high speed NETHH is set higher than the upper engine speed in the execution condition (1), and the predetermined low coolant temperature TWTHL is set lower than the predetermined temperature in the execution condition (5), it is possible to make the failure determination easier to start, and hard to stop (interrupt).

When the decision in step S12 is affirmative (YES), stop condition determination based on a specific operational state parameter XOP is executed in steps S13 to S17. One of an intake air flow rate GAIR, a cylinder intake air amount GAIRCYL, the engine speed NE, and the suction pressure PBA is used as the specific operational state parameter XOP. The cylinder intake air amount GAIRCYL is the amount of cylinder intake air per one TDC period (cycle of generating the TDC pulse) which is calculated by a known scheme (disclosed in, for example, Japanese Unexamined Patent Application Publication No. 2011-144683, the entire contents of which are incorporated herein by reference) based on the intake air flow rate GAIR.

In step S13, it is determined whether the specific operational state parameter XOP is larger than a predetermined lower limit XOPLML. When the decision in step S13 is affirmative (YES), it is determined whether the specific operational state parameter XOP is less than a predetermined upper limit XOPLMH (step S14). When the decision in step S13 or step S14 is negative (NO), the routine proceeds to the step S19.

When the decision in step S14 is affirmative (YES), the absolute value DXOPA of a change in the specific operational state parameter XOP (hereinafter referred to as "change absolute value DXOPA") is calculated from the following equation 11 (step S15). XOPZ in the equation 11 is the previous value of the specific operational state parameter XOP.

$$DXOPA=|XOP-XOPZ| \quad (11)$$

In step S16, the change absolute value DXOPA is substituted in the following equation 12 to calculate a change integrated value IDXOP. IDXOPZ in the equation 12 is the previous value of the change integrated value IDXOP.

$$IDXOP=IDXOPZ+DXOPA \quad (12)$$

In step S17, it is determined whether the change integrated value IDXOP is smaller than a predetermined threshold value IDXOPTH. When the decision in step S17 is affirmative (YES), the stop condition flag FDSTP is set to "0". Therefore, the LAF sensor failure determination routine continues.

When the decision in step S17 is negative (NO) and the change integrated value IDXOP is equal to or higher than the predetermined threshold value IDXOPTH, it is determined that the stop condition is fulfilled, and the routine proceeds to the step S19.

Figure 4:
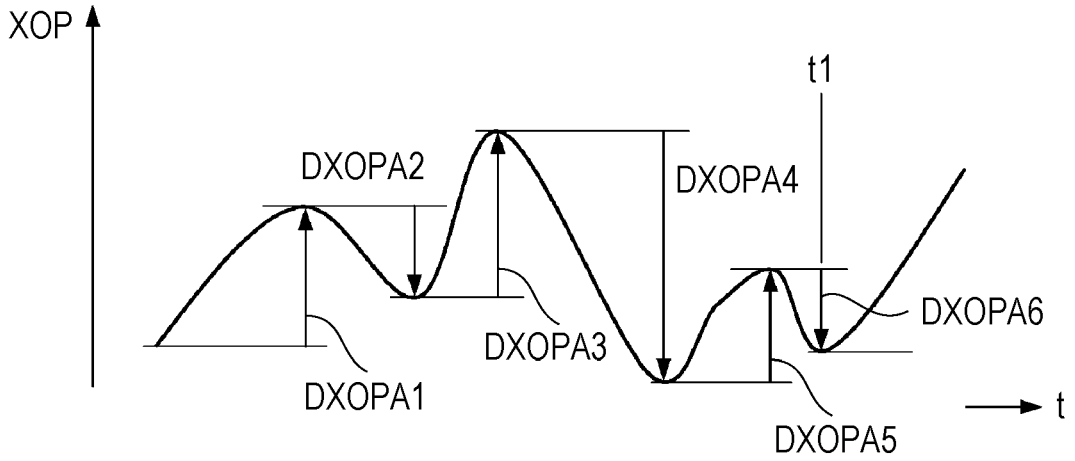
FIG. 4 is a time chart for explaining the routine of FIG. 3.

The change integrated value IDXOP becomes a value equivalent to the sum of change absolute values DXOPA1 to DXOPA6, for example, at time t1 shown in FIG. 4, and reflects the history of variations in the directions of increasing and decreasing the specific operational state parameter XOP.

FIG. 5 is a flowchart of the LAF sensor failure determination routine which is executed in step S5 in FIG. 2.

In step S101, a band-pass filtering process of extracting the frequency f1 component is performed on the detection equivalence ratio KACT which is calculated from the LAF sensor output, and a frequency f1 component intensity MPTf1 is calculated by integrating the absolute value (amplitude) of the output provided by the band-pass filtering process.

In step S102, a band-pass filtering process of extracting the frequency f2 component is performed, and a frequency f2 component intensity MPTf2 is calculated by integrating the absolute value (amplitude) of the output provided by the band-pass filtering process.

In step S103, it is determined whether a predetermined integration time TINT has elapsed since the time of initiation of the calculation of the frequency component intensity. When the decision in step S103 is negative (NO), the routine is terminated immediately. When the decision in step S103 is affirmative (YES), the routine proceeds to step S104 to determine whether the frequency f1 component intensity MPTf1 is smaller than an intensity determination threshold value MPTf1TH.

When the decision in step S104 is affirmative (YES), it is determined that a failure of a first failure pattern has occurred in which the response characteristic of the LAF sensor output on the rich side and the response characteristic of the LAF sensor output on the lean side are deteriorated substantially similarly (step S105). When the decision in step S104 is negative (NO), the frequency f1 component intensity MPTf1 and the frequency f2 component intensity MPTf2 are substituted in the following equation 13 to calculate a decision parameter RTLAF (step S106).

$$RTLAF=MPTf1/MPTf2 \quad (13)$$

In step S107, it is determined whether the decision parameter RTLAF is larger than a decision threshold value RTLAFTH. When the decision in step S107 is negative (NO), it is determined that a failure of a second failure pattern has occurred in which the response characteristic of the LAF sensor output on the rich side and the response characteristic of the LAF sensor output on the lean side are deteriorated asymmetrically (step S108). When the decision in step S107 is affirmative (YES), it is determined that the LAF sensor 15 is normal (failure originated from the deterioration of the response characteristic has not occurred) (step S109).

Figure 14A:
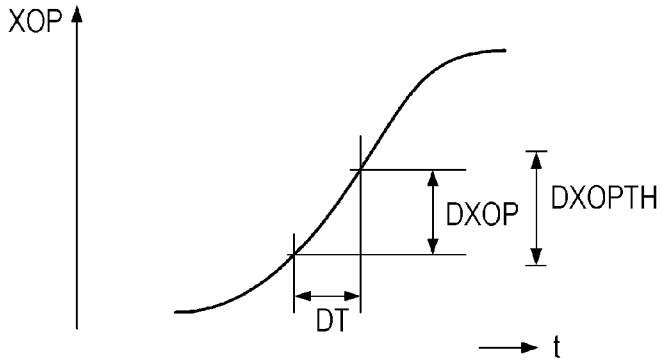
FIG. 14A BACKGROUND ART
FIGS. 14A and 14B are diagrams for explaining the problems of the related art.
Figure 14B:
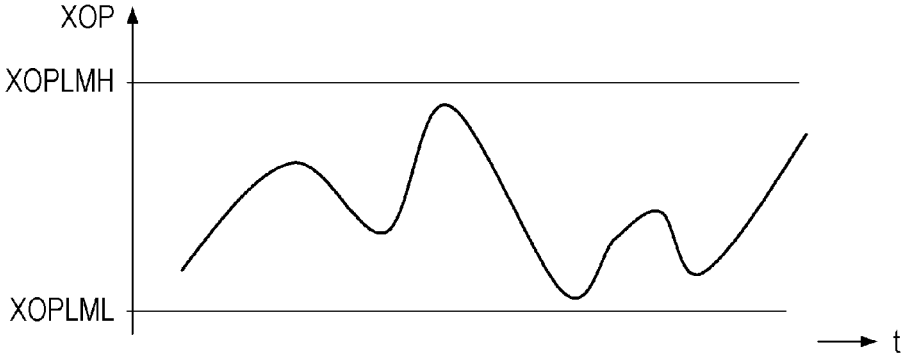

According to the first embodiment, as described above, the frequency f1 component and the frequency f2 component included in the detection equivalence ratio KACT which is calculated from the output signal of the LAF sensor 15 during the failure determination period are extracted, and a failure originated from the deterioration of the response characteristic of the LAF sensor 15 is carried out based on those frequency components. The change integrated value IDXOP that represents the state of a variation in the specific operational state parameter XOP after initiation of the failure determination, and reflects the variational history of the operational state parameter is calculated, and the failure determination is interrupted (stopped) when the change integrated value IDXOP is equal to or larger than the predetermined threshold value IDXOPTH. The use of the change integrated value IDXOP reflecting the variational history of the operational state parameter makes it possible to overcome the problems of the scheme according to the related art which has been described referring to FIGS. 14A and 14B, and prevent erroneous failure determination which would originate from the influence of a variation in the specific operational state parameter XOP on the frequency f1 component intensity MPTf1 and the frequency f2 component intensity MPTf2, thereby improving the failure determination accuracy.

Moreover, the change integrated value IDXOP is calculated when the specific operational state parameter XOP lies within the range of the predetermined upper and lower limits XOPLMH, XOPLML after initiation of the failure determination period, so that when the specific operational state parameter XOP changes to a value not suitable for failure determination, calculation of the change integrated value IDXOP is stopped. This makes it possible to avoid improper stop condition determination based on the change integrated value IDXOP, thus preventing the failure determination accuracy from dropping.

Furthermore, the change integrated value IDXOP reflecting the variational history of the specific operational state parameter XOP can be calculated through a relatively simple operation, and adequately represents the variational history of the specific operational state parameter XOP. This makes it possible to more adequately determine whether or not to execute failure determination without increasing the operational load on the CPU of the ECU 5, thus improving the failure determination accuracy.

According to the embodiment, the LAF sensor 15 is equivalent to the air-fuel ratio detector, the intake air flow rate sensor 7, the suction pressure sensor 8 and the crank angle position sensor 11 are equivalent to the operational state parameter acquiring device, the fuel injection valves 6 constitute part of the air-fuel ratio variation device, and the ECU 5 constitutes part of the fuel amount controller and the air-fuel ratio controller, part of the operational state parameter acquiring device, the extractor, the failure determination device, the variation state parameter calculator, and the determination stopping device. Specifically, steps S101 and S102 in FIG. 5 are equivalent to the extractor, steps S104 to S109 in FIG. 5 are equivalent to the failure determination device, steps S13 to S16 in FIG. 3 are equivalent to the variation state parameter calculator, steps S17 and S19 in FIG. 3 and step S4 in FIG. 2 are equivalent to the determination stopping device.

First Modification

Figure 6:
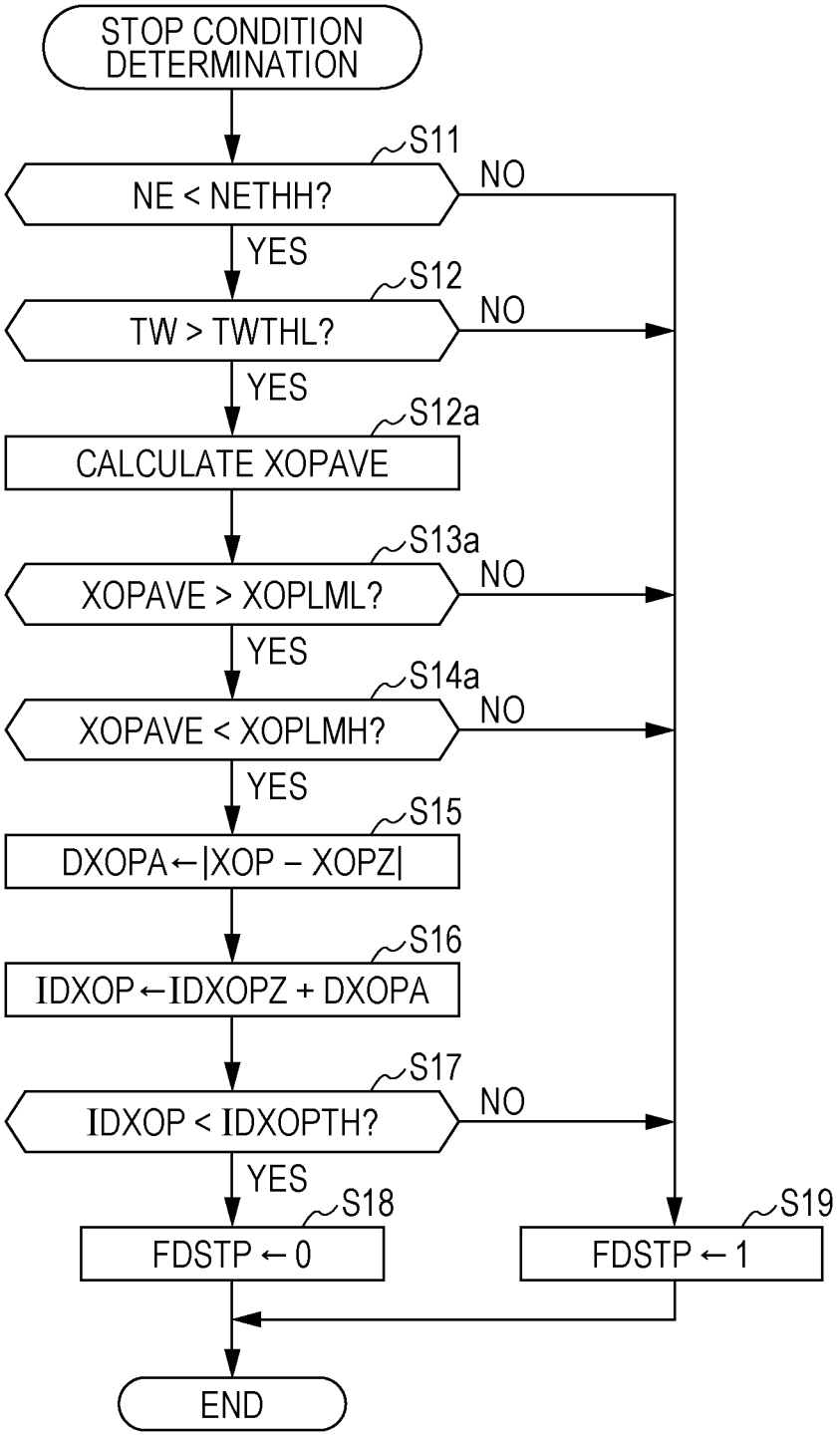
FIG. 6 is a flowchart illustrating a first modification of the routine illustrated in FIG. 3.

The routine of FIG. 3 may be modified to the one illustrated in FIG. 6. The routine illustrated in FIG. 6 includes steps S13*a* and S14*a* in place of steps S13 and S14 in FIG. 3, and additionally includes step S12*a*.

In step S12*a*, a shift average value XOPAVE which is an average value of predetermined pieces of data including the current value of the specific operational state parameter XOP is calculated. In step S13*a*, it is determined whether the shift average value XOPAVE is equal to or larger than the predetermined lower limit XOPLML. When the decision in step S13*a* is affirmative (YES), it is determined whether the shift average value XOPAVE is smaller than the predetermined upper limit XOPLMH (step S14*a*). When the decision in step S13*a* or step S14*a* is negative (NO), the routine proceeds to step S19. When the decision in step S14*a* is affirmative (YES), the routine proceeds to step S15.

According to the first modification, calculation of the change integrated value IDXOP is executed when the shift average value XOPAVE lies within the range of the predetermined upper and lower limits, so that the influence of a slight variation in the specific operational state parameter XOP can be canceled to stabilize the stop condition determination.

Second Modification

Figure 7:
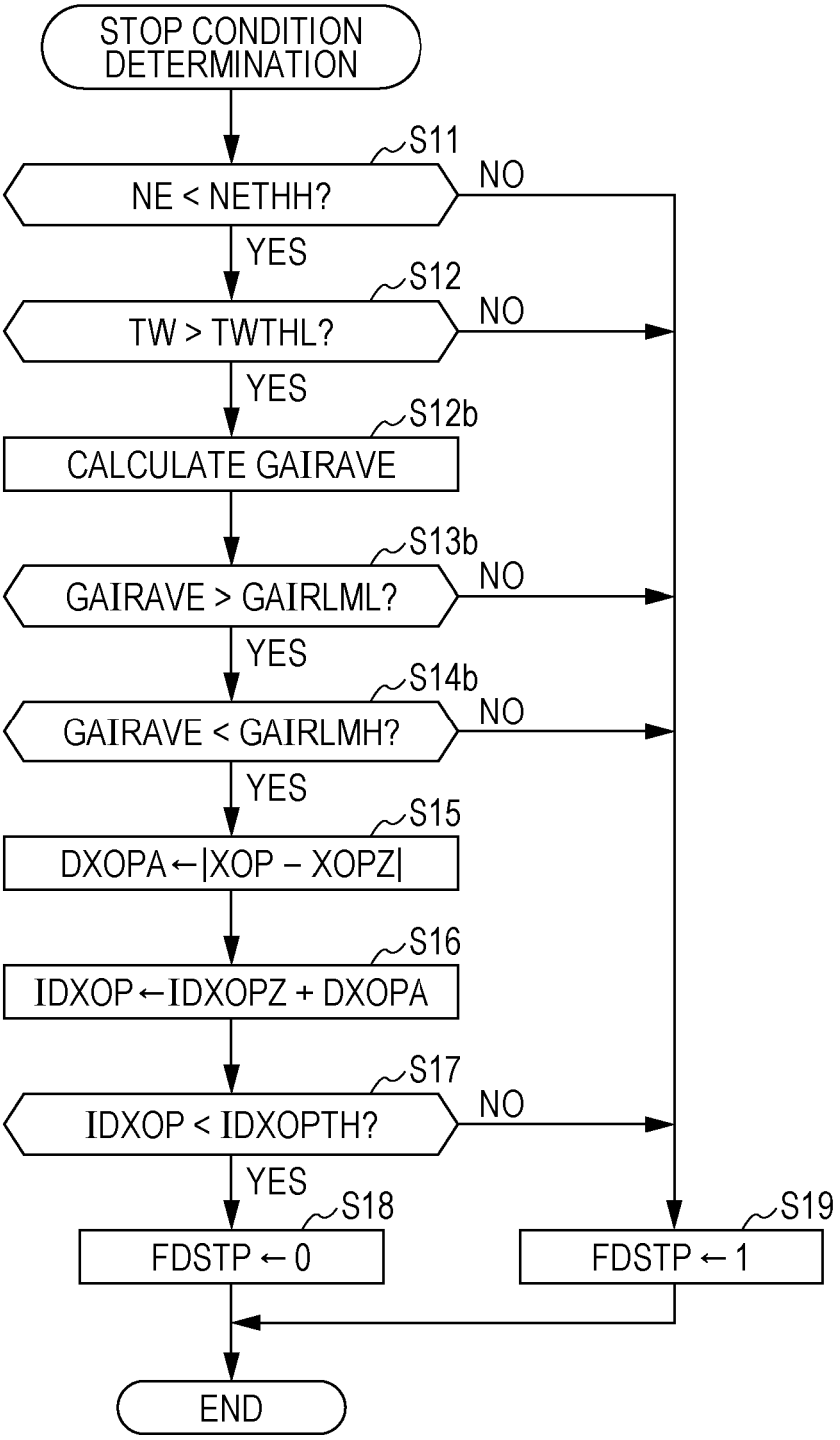
FIG. 7 is a flowchart illustrating a second modification of the routine illustrated in FIG. 3.

The routine of FIG. 3 may be modified to the one illustrated in FIG. 7. The routine illustrated in FIG. 7 includes steps S13*b* and S14*b* in place of steps S13 and S14 in FIG. 3, and additionally includes step S12*b*.

In step S12*b*, an average intake air flow rate GAIRAVE which is an average shift value of predetermined pieces of data including the current value of the intake air flow rate GAIR is calculated. In step S13*b*, it is determined whether the average intake air flow rate GAIRAVE is equal to or larger than the predetermined lower limit GAIRLML. When the decision in step S13*b* is affirmative (YES), it is determined whether the average intake air flow rate GAIRAVE is smaller than the predetermined upper limit GAIRLMH (step S14*b*). When the decision in step S13*b* or step S14*b* is negative (NO), the routine proceeds to step S19. When the decision in step S14*b* is affirmative (YES), the routine proceeds to step S15.

According to the second modification, calculation of the change integrated value IDXOP is executed when the average intake air flow rate GAIRAVE lies within the range of the predetermined upper and lower limits, so that the influence of a slight variation in the intake air flow rate GAIR can be canceled to stabilize the stop condition determination.

Third Modification

Although one of the intake air flow rate GAIR, the cylinder intake air amount GAIRCYL, the engine speed NE, and the suction pressure PBA is used as the specific operational state parameter XOP according to the embodiment, the stop condition determination routine of FIG. 3 may be executed on two or more parameters among those operational state parameters, and failure determination may be interrupted (stopped) when the stop condition is fulfilled (when the stop condition flag FDSTP is set to "1") for any one of the operational state parameters.

Second Embodiment

Figure 8:
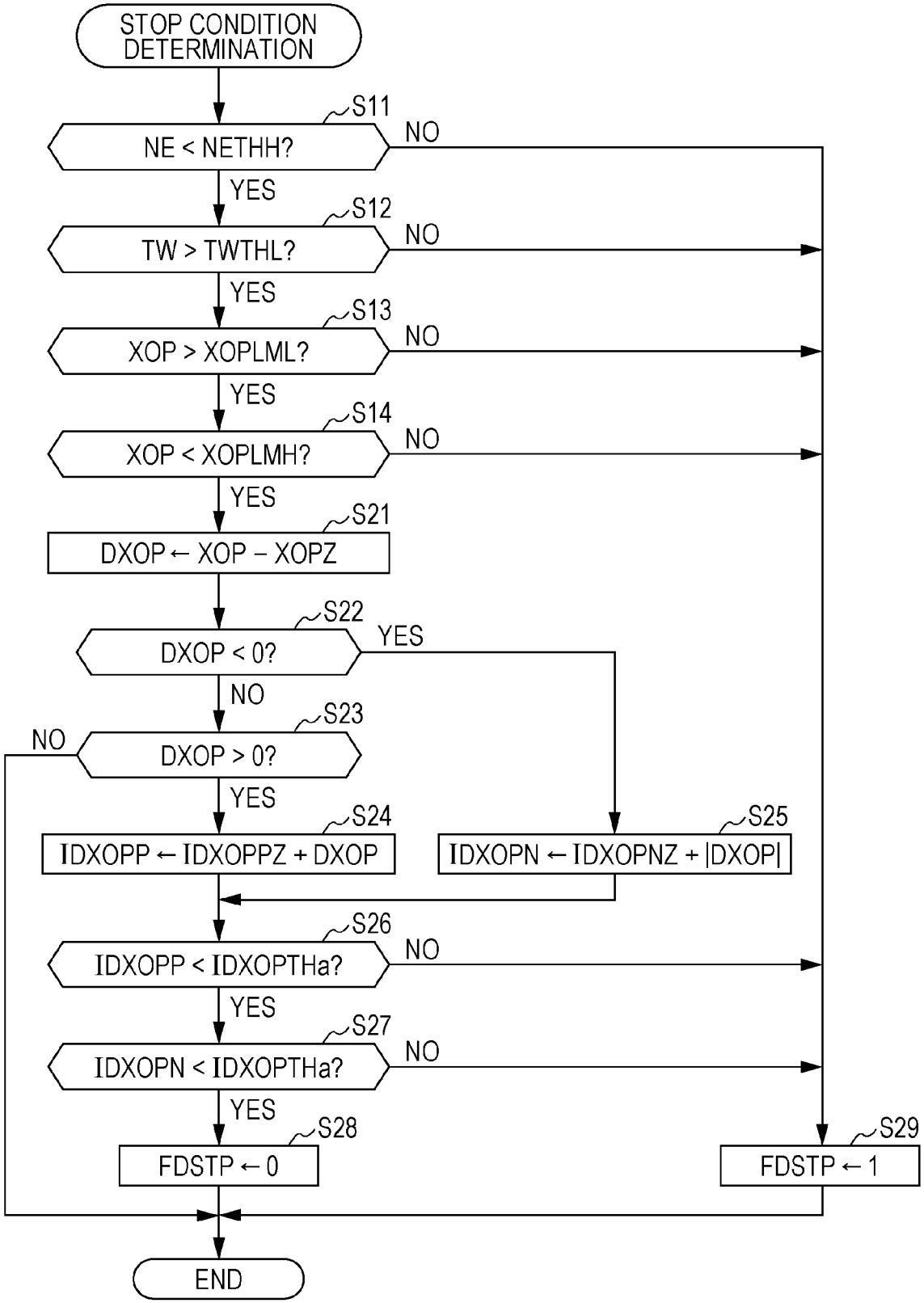
FIG. 8 is a flowchart of a stop condition determination routine (second embodiment).

FIG. 8 is a flowchart of a stop condition determination routine according to the second embodiment. The routine of FIG. 8 has steps S15 to S19 in FIG. 3 replaced with steps S21 to S29. The second embodiment is identical to the first embodiment except for the following points to be described.

In step S21, a change DXOP in the specific operational state parameter XOP is calculated from the following equation 21. The right hand side of the equation 21 is equivalent to the equation 11 with the symbol of an absolute value deleted.

$$DXOP=XOP-XOPZ \tag{21}$$

In step S22, it is determined whether the change DXOP is a negative value. When the decision in step S22 is affirmative (YES), a decrease integrated value IDXOPN is calculated from the following equation 22 (step S25). IDXOPNZ in the equation 22 is the is the previous value of the decrease integrated value IDXOPN.

$$IDXOPN=IDXOPNZ+|DXOP| \tag{22}$$

When the decision in step S22 is negative (NO), it is determined whether the change DXOP is a positive value (step S23). When the decision in step S23 is affirmative (YES), an increase integrated value IDXOPP is calculated from the following equation 23. IDXOPPZ in the equation 23 is the previous value of the increase integrated value IDXOPP.

$$IDXOPP=IDXOPPZ+DXOP \tag{23}$$

When the decision in step S23 is negative (NO), i.e., when DXOP=0, the routine is terminated immediately.

After execution of step S24 or step S25, the routine proceeds to step S26 to determine whether the increase integrated value IDXOPP is smaller than a predetermined threshold value IDXOPTHa. When the decision in step S26 is affirmative (YES), it is further determined whether the decrease integrated value IDXOPN is smaller than the predetermined threshold value IDXOPTHa (step S27).

When the decision in step S26 or step S27 is negative (NO), it is determined that the failure determination routine should be stopped, and the stop condition flag FDSTP is set to "1" (step S29). When the decision in step S27 is affirmative (YES), the stop condition flag FDSTP is set to "0" (step S28).

According to the routine of FIG. 8, at time t1 shown in FIG. 4, for example, the increase integrated value IDXOPP becomes a value equivalent to the sum of change absolute values DXOPA1, DXOPA3 and DXOPA5, and the decrease integrated value IDXOPN becomes a value equivalent to the sum of change absolute values DXOPA2, DXOPA4 and DXOPA6, the increase integrated value IDXOPP and the decrease integrated value IDXOPN respectively reflecting the history of variations in the direction of increasing the specific operational state parameter XOP and the history of variations in the direction of decreasing the specific operational state parameter XOP. Therefore, the increase integrated value IDXOPP and the decrease integrated value IDXOPN adequately representing the variational histories of the specific operational state parameter XOP are obtained through a relatively simple operation, making it possible to more adequately determine whether or not to execute failure determination without increasing the operational load on the CPU of the ECU 5, thus improving the failure determination accuracy.

According to the second embodiment, steps S13, S14, and S21 to S24 in FIG. 8 are equivalent to the variation state parameter calculator, and steps S26 and S27 in FIG. 8 are equivalent to the determination stopping device.

Modification

When the decisions in steps S26 and S27 are both negative (NO), the stop condition flag FDSTP may be set to "1". Further, the second embodiment may be modified in the same way as the first, second or third modification of the first embodiment.

Third Embodiment

Figure 9:
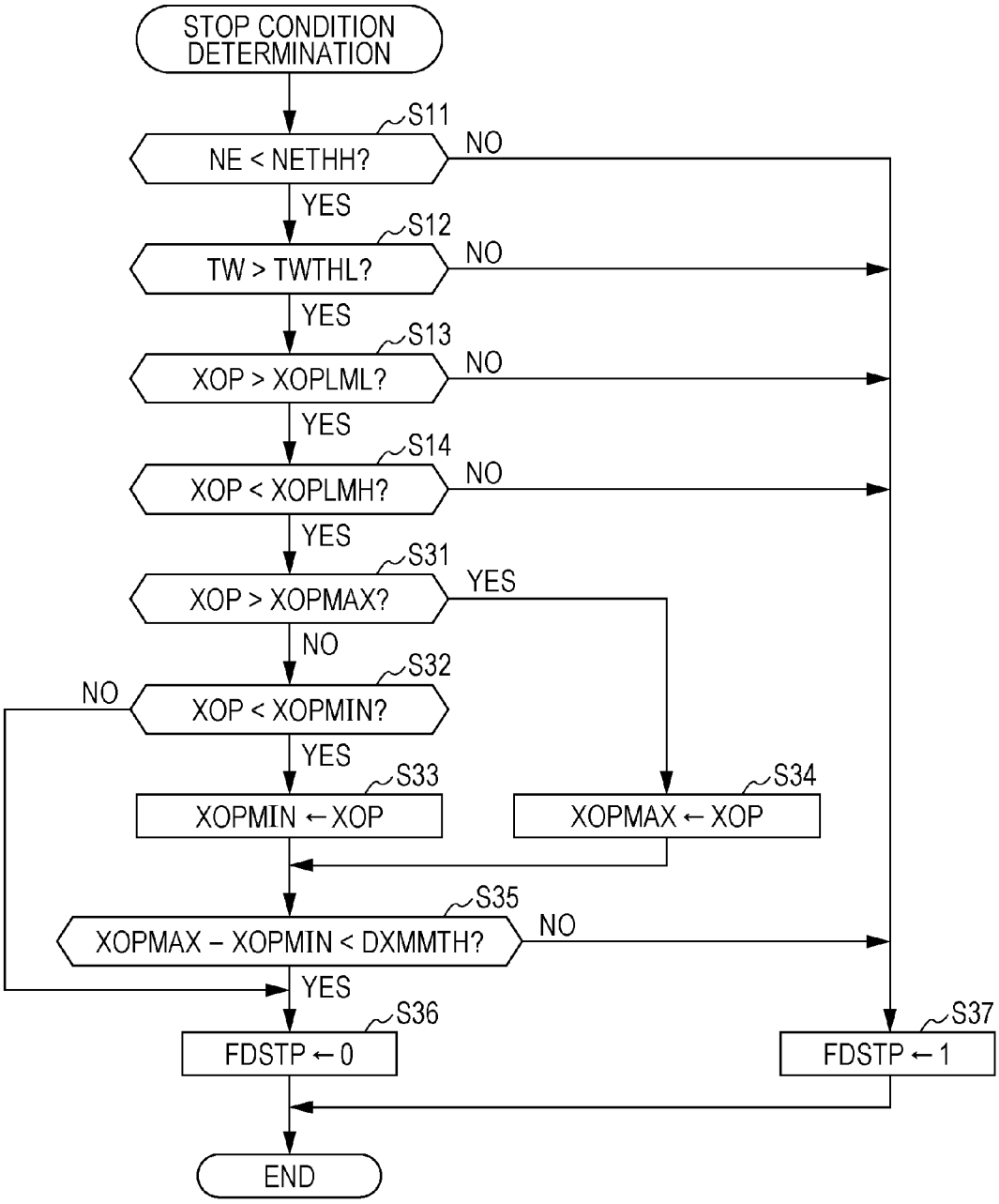
FIG. 9 is a flowchart of a stop condition determination routine (third embodiment).
Figure 10:
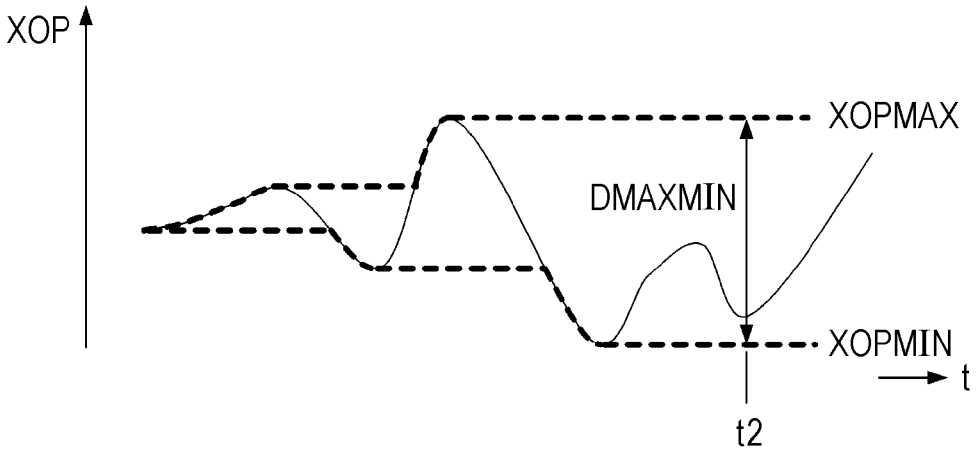
FIG. 10 is a time chart for explaining the routine of FIG. 9.

FIG. 9 is a flowchart of a stop condition determination routine according to the third embodiment. The routine of FIG. 9 has steps S15 to S19 in FIG. 3 replaced with steps S31 to S37. The third embodiment is identical to the first embodiment except for the following points to be described.

In step S31, it is determined whether the specific operational state parameter XOP is larger than a maximum value XOPMAX. The maximum value XOPMAX is initialized to a small value which the specific operational state parameter XOP does not normally take, so that the decision in step S31 at first is affirmative (YES), and the maximum value XOPMAX is updated to the current value of the specific operational state parameter XOP in step S34.

When the decision in step S31 is negative (NO), it is determined whether the specific operational state parameter XOP is smaller than a minimum value XOPMIN (step S32). The minimum value XOPMIN is initialized to a large value which the specific operational state parameter XOP does not normally take, so that the decision in step S32 at first is affirmative (YES), and the minimum value XOPMIN is updated to the current value of the specific operational state parameter XOP in step S33. When the decision in step S32 is negative (NO), the routine proceeds to step S36.

After execution of step S33 or step S34, the routine proceeds to step S35 to determine whether the difference between the maximum value XOPMAX and the minimum value XOPMIN is smaller than a predetermined threshold value DXMMTH. When the decision in step S35 is negative (NO), it is determined that the failure determination routine should be stopped, and the stop condition flag FDSTP is set to "1" (step S37). When the decision in step S35 is affirmative (YES), the stop condition flag FDSTP is set to "0" (step S36).

According to the routine of FIG. 9, the maximum value XOPMAX and the minimum value XOPMIN are calculated, and the difference between both values XOPMAX and XOPMIN at time t2 is given by DMAXMIN. Therefore, the difference DMAXMIN as the variation state parameter that reflects the history of variations in the direction of increasing the specific operational state parameter XOP and the history of variations in the direction of decreasing the specific operational state parameter XOP, and adequately represents the variational history in which the output characteristic of the LAF sensor 15 of the specific operational state parameter XOP is obtained through a relatively simple operation. Consequently, it is possible to more adequately determine whether or not to execute failure determination without increasing the operational load on the CPU of the ECU 5, thus improving the failure determination accuracy.

According to the third embodiment, steps S13, S14, and S31 to S34 in FIG. 9 are equivalent to the variation state parameter calculator, and step S35 in FIG. 9 is equivalent to the determination stopping device.

Modification

The third embodiment may also be modified in the same way as the first, second or third modification of the first embodiment.

Fourth Embodiment

Figure 11:
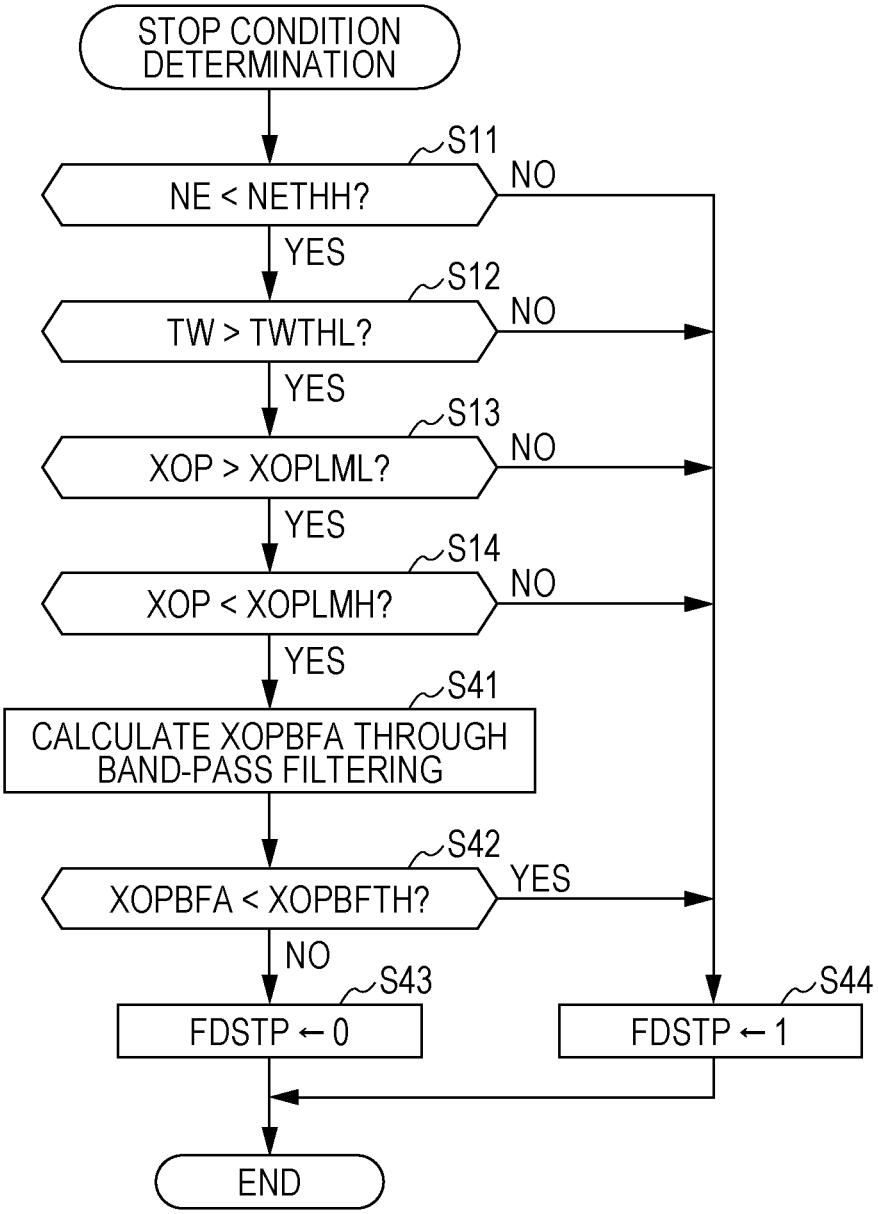
FIG. 11 is a flowchart of a stop condition determination routine (fourth embodiment).

FIG. 11 is a flowchart of a stop condition determination routine according to the fourth embodiment. The routine of FIG. 11 has steps S15 to S19 in FIG. 3 replaced with steps S41 to S44. The routine of FIG. 11 is executed every predetermined crank angle. The fourth embodiment is identical to the first embodiment except for the following points to be described.

In step S41, a band-pass filtering process of extracting a frequency component in the vicinity of the frequency f1 component is performed for the specific operational state parameter XOP to calculate a filtered parameter XOPBFA. The band-pass filtering process is carried out using the following equation 31, and the filtered parameter XOPBFA is equivalent to the absolute value of a filter output XOPBF which is calculated using the equation 31.

$$XOPBF(k) = \sum_{i=0}^{N} a(i) \cdot XOP(k-i) - \sum_{j=1}^{M} b(j) \cdot XOPBF(k-j) \tag{31}$$

The quantity of data (N+1) of the specific operational state parameter XOP to be used in the equation 31 is set to, for example, a value equal to or greater than "3". "N" and "M" in the equation 31 are parameters (integers) set to values according to the needed filter characteristic, and "a" and "b" are filter coefficients set to values according to the needed filter characteristic. According to the fourth embodiment, the passband width in the band-pass filtering process in step S41 is set wider than the passband width in the band-pass filtering process adopted to extract the frequency f1 component in step S101 in FIG. 5.

In step S42, it is determined whether the filtered parameter XOPBFA is smaller than a predetermined threshold value XOPBFTH. When the decision in step S42 is negative (NO), it is determined that the failure determination routine should be stopped, and the stop condition flag FDSTP is set to "1" (step S44). When the decision in step S42 is affirmative (YES), the stop condition flag FDSTP is set to "0" (step S43).

Because the current value of the specific operational state parameter XOP and N old values are adopted in the band-pass filtering process in FIG. 11, the filtered parameter XOPBFA reflects the variational history of the specific operational state parameter XOP. Therefore, it is possible to surely determine, through a relatively simple operation, the state where a variation frequency component which significantly influences the frequency f1 component and the frequency f2 component both used in failure determination is included in the specific operational state parameter XOP. Consequently, it is possible to more adequately determine whether or not to execute failure determination without increasing the operational load on the CPU of the ECU 5, thus improving the failure determination accuracy.

According to the fourth embodiment, steps S13, S14, and S41 in FIG. 11 are equivalent to the variation state parameter calculator, and step S42 in FIG. 11 is equivalent to the determination stopping device.

Modification

The fourth embodiment may also be modified in the same way as the first, second or third modification of the first embodiment.

The disclosure is not limited to the foregoing embodiments, and can be modified in various other forms. Although the process of determining a failure originated from the deterioration of the response characteristic of the LAF sensor 15 is illustrated as the failure determination process of the air-fuel ratio control system according to the foregoing embodiments, for example, the disclosure may be adapted to determination of the stop condition for determining an imbalance failure in which the air-fuel ratio for each cylinder varies beyond the allowable limit.

Figure 12:
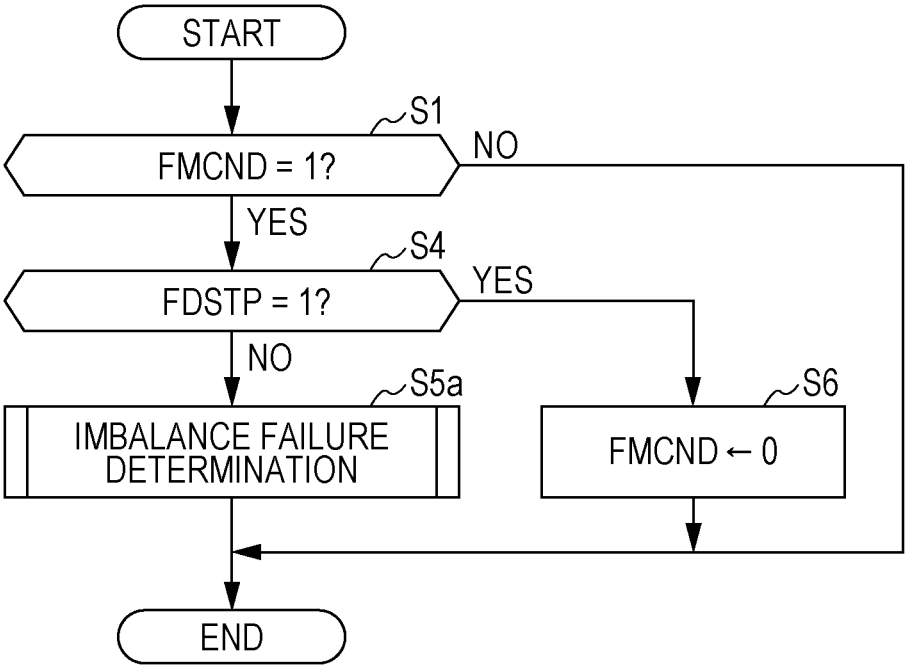
FIG. 12 is a flowchart illustrating a modification of the routine illustrated in FIG. 2.
Figure 13:
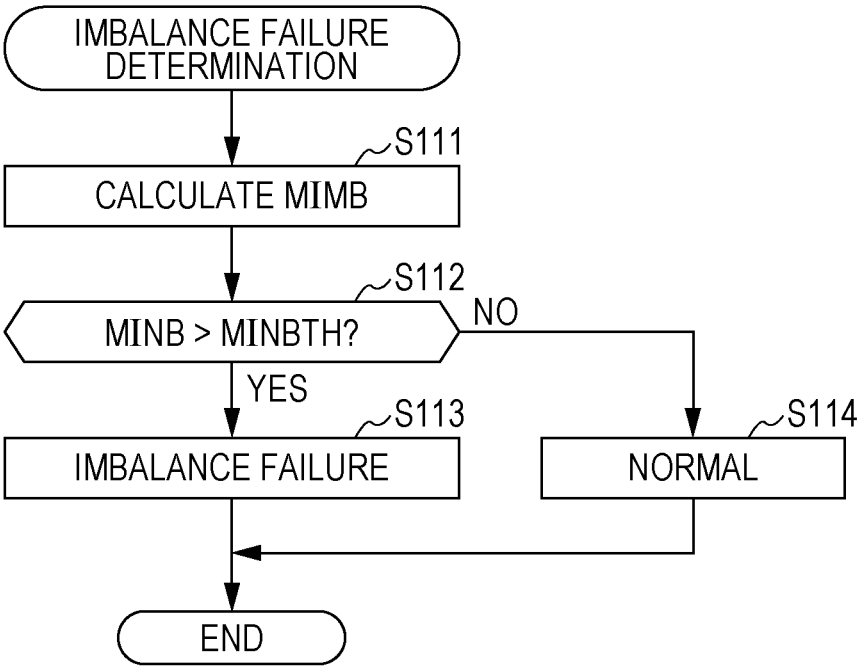
FIG. 13 is a flowchart of an imbalance failure determination routine which is executed in the routine of FIG. 12.

FIG. 12 shows a flowchart which is the flowchart of FIG. 2 modified for imbalance failure determination, does not include steps S2 and S3 in FIG. 2, and has step S5 in FIG. 2 replaced with step S5*a*. In step S5*a* in FIG. 12, an imbalance failure determination routine illustrated in FIG. 13 is executed in place of the LAF sensor failure determination routine. That is, in the imbalance failure determination, air-fuel ratio control is not carried out, and failure determination is carried out based on the intensity, MIMB, of a frequency component (0.5th-order frequency component) which is equivalent to the a half of the frequency corresponding to the engine speed and is included in the detection equivalence ratio KACT during execution of the air-fuel ratio feedback control according to the detection equivalence ratio KACT.

In step S111 in FIG. 13, the band-pass filtering process of extracting the 0.5th-order frequency component is performed for the detection equivalence ratio KACT, and the 0.5th-order frequency component intensity MIMB is calculated by integrating the absolute value (amplitude) of the band-pass filtered output. In step S112, it is determined whether the 0.5th-order frequency component intensity MIMB is larger than a predetermined threshold value MINBTH.

When the decision in step S111 is affirmative (YES), it is determined that an imbalance failure has occurred (step S113). When the decision in step S112 is negative (NO), it is determined a variation in the air-fuel ratio for each cylinder lies within the allowable limit (imbalance failure has not occurred) (step S114).

The imbalance failure determining scheme illustrated in FIG. 13 is identical to the scheme disclosed in, for example, Japanese Unexamined Patent Application Publication No. 2009-270543, the entire contents of which are incorporated herein by reference. This modification can prevent the determination accuracy in the imbalance failure determination from dropping due to a variation in the specific operational state parameter XOP.

According to the modification, the routine of FIG. 13 is equivalent to the failure determination device.

When this modification is adapted to the fourth embodiment, the band-pass filtering process with the passband lying in the vicinity of a 0.5th-order frequency is executed in step S41 in FIG. 11. The passband width of the band-pass filtering process is set wider than the passband width of the band-pass filtering process which is adapted to extraction of a 0.5th-order frequency component in step S111 in FIG. 13.

The imbalance failure determining scheme is not limited to the foregoing scheme, but the scheme disclosed in, for example, Japanese Unexamined Patent Application Publication No. 2011-144754, the entire contents of which are incorporated herein by reference, may be used as well. In addition, the scheme of determining a failure originated from the deterioration of the response characteristic of the LAF sensor is not limited to the foregoing scheme, but the scheme disclosed in, for example, Japanese Unexamined Patent Application Publication No. 2010-133418, the entire contents of which are incorporated herein by reference, may be used as well.

The disclosure may be adapted to an air-fuel ratio control apparatus for a ship propelling engine such as an outboard engine having the crank shaft set vertically.

According to one aspect of an exemplary embodiment of the disclosure, an air-fuel ratio control apparatus for an internal combustion engine having a plurality of cylinders includes an air-fuel ratio detection unit that detects an air-fuel ratio (KACT) in an exhaust passage of the internal combustion engine, a fuel amount control unit that controls an amount of fuel (TOUT) to be supplied to each of the plurality of cylinders, an operational state parameter acquiring unit that acquires at least one operational state parameter (XOP) representing an operational state of the internal combustion engine, an extraction unit that extracts a specific frequency component (frequency f1 component, 0.5th-order frequency component) from a detection signal from the air-fuel ratio detection unit during a failure determination period, a failure determination unit that executes failure determination of determining a failure in an air-fuel ratio control system of the internal combustion engine based on the extracted specific frequency component, a variation state parameter calculation unit that calculates a variation state parameter (IDXOP, IDXOPP, IDXOPN, (XOPMAX-XOPMIN), XOPBFA) representing a state of a variation in the operational state parameter after initiation of the failure determination period, and reflecting a variational history of the operational state parameter, and a determination stopping unit that interrupts or stops the failure determination upon detection of a specific variation state where the variation state parameter is equal to or larger than a predetermined threshold value, the specific operational state influencing an intensity of the specific frequency component extracted by the extraction unit.

According to the aspect, a specific frequency component is extracted from the detection signal from the air-fuel ratio detection unit during the failure determination period, and a failure in the air-fuel ratio control system is determined based on the extracted specific frequency component. A variation state parameter representing the state of a variation in the operational state parameter after initiation of the failure determination period, and reflecting the variational history of the operational state parameter is calculated. Upon detection of a specific variation state where the variation state parameter is equal to or larger than the predetermined threshold value, i.e., upon detection a variation state which influences intensity of the specific frequency component extracted by the extraction unit, failure determination is interrupted or stopped. Detection of such a specific variation state by using the variation state parameter reflecting the variational history of the operational state parameter makes it possible to prevent erroneous failure determination which would originate from the influence of a variation in the operational state parameter on the intensity of a specific frequency component, thereby improving the failure determination accuracy. When the average value of operational state parameters is used as a variation state parameter, the specific variation state cannot be detected, so that the average value of operational state parameters is not included in the variation state parameter.

It is preferable that in the air-fuel ratio control apparatus according to the aspect, the variation state parameter calculation unit calculates the variation state parameter when the operational state parameter (XOP) or an average value (XOPAVE) of the operational state parameter lies within a range of predetermined upper and lower limits (XOPLMH, XOPLML) after initiation of the failure determination period.

According to the configuration, the variation state parameter is calculated when the operational state parameter or an average value of the operational state parameter lies within the range of predetermined upper and lower limits after initiation of the failure determination period. When the operational state parameter changes to a value not suitable for failure determination, therefore, calculation of the variation state parameter is stopped. This makes it possible to avoid improper stop condition determination based on the variation state parameter, thus preventing the failure determination accuracy from dropping.

It is preferable that in the air-fuel ratio control apparatus according to the aspect, the operational state parameter acquiring unit acquires a plurality of operational state parameters, and the variation state parameter calculation unit calculates the variation state parameter when another operational state parameter (GAIR) different from the operational state parameter which is used in calculating the variation state parameter or an average value (GAIRAVE) of the another operational state parameter lies within a range of predetermined upper and lower limits after initiation of the failure determination period.

According to this configuration, the variation state parameter is calculated when another operational state parameter different from the operational state parameter which is used in calculating the variation state parameter or the average value of the another operational state parameter lies within a range of predetermined upper and lower limits after initiation of the failure determination period. When another operational state parameter changes to a value not suitable for failure determination, therefore, calculation of the variation state parameter is stopped. This makes it possible to avoid improper stop condition determination based on the variation state parameter, thus preventing reduction in the failure determination accuracy.

It is preferable that in the air-fuel ratio control apparatus according to the aspect, the variation state parameter calculation unit calculates the variation state parameter (IDXOP) by integrating an absolute value (DXOPA) of a change in the operational state parameter after initiation of the failure determination period.

According to this configuration, the variation state parameter is calculated by integrating the absolute value of a change in the operational state parameter after initiation of the failure determination period. Therefore, the variation state parameter adequately representing the variational history of the operational state parameter is obtained through a relatively simple operation. Consequently, it is possible to more adequately determine whether or not to execute failure determination without increasing the operational load on the control apparatus, thus improving the failure determination accuracy.

It is preferable that in the air-fuel ratio control apparatus according to the aspect, the variation state parameter calculation unit calculates an increase integrated value (IDXOPP) by integrating a positive amount of change in the operational state parameter and a decrease integrated value (IDXOPN) by integrating a negative amount of change in the operational state parameter after initiation of the failure determination period to thereby calculate at least one of the increase integrated value and the decrease integrated value as the variation state parameter.

According to this configuration, the increase integrated value is calculated by integrating a positive amount of change in the operational state parameter, and the decrease integrated value is calculated by integrating a negative amount of change in the operational state parameter after initiation of the failure determination period to thereby calculate at least one of the increase integrated value and the decrease integrated value as the variation state parameter. Therefore, the variation state parameter adequately representing the history of an increase and/or a decrease in the operational state parameter is obtained through a relatively simple operation. Consequently, it is possible to more adequately determine whether or not to execute failure determination without increasing the operational load on the control apparatus, thus improving the failure determination accuracy.

It is preferable that in the air-fuel ratio control apparatus according to the aspect, the variation state parameter calculation unit updates a maximum value (XOPMAX) and a minimum value (XOPMIN) of the operational state parameter after initiation of the failure determination period, and calculates a difference between the maximum value and the minimum value (XOPMAX−XOPMIN) as the variation state parameter.

According to this configuration, the maximum value and a minimum value of the operational state parameter after initiation of the failure determination period are updated, and the difference between the maximum value and the minimum value is calculated as the variation state parameter. Accordingly, it is possible to surely determine the variational history which provides a significant change in the output characteristic of the air-fuel ratio detection unit through a relatively simple operation. Consequently, it is possible to more adequately determine whether or not to execute failure determination without increasing the operational load on the control apparatus, thus improving the failure determination accuracy.

It is preferable that in the air-fuel ratio control apparatus according to the aspect, the variation state parameter calculation unit executes a band-pass filtering process of extracting a predetermined frequency component included in the operational state parameter after initiation of the failure determination period, and calculates an operational state parameter (XOPBFA) after the band-pass filtering process as the variation state parameter.

According to this configuration, the band-pass filtering process of extracting a predetermined frequency component included in the operational state parameter after initiation of the failure determination period is executed, and an operational state parameter after the band-pass filtering process is calculated as the variation state parameter. This makes it possible to surely determine, through a relatively simple operation, the state where a variation frequency component which significantly influences a specific frequency component to be used in failure determination is included in the operational state parameter. Consequently, it is possible to more adequately determine whether or not to execute failure determination without increasing the operational load on the control apparatus, thus improving the failure determination accuracy.

It is preferable that in the air-fuel ratio control apparatus according to the aspect, the specific frequency component is a 0.5th-order frequency component which is a frequency component equivalent to a half of a frequency corresponding to an engine speed of the internal combustion engine, and the failure determination unit determines an imbalance failure such that an air-fuel ratio corresponding to each of the plurality of cylinders varies beyond an allowable limit, based on the 0.5th-order frequency component.

According to this configuration, the specific frequency component is a 0.5th-order frequency component which is a frequency component equivalent to a half of a frequency corresponding to the engine speed of the internal combustion engine, and an imbalance failure such that an air-fuel ratio corresponding to each of the plurality of cylinders varies beyond an allowable limit is determined based on the 0.5th-order frequency component. It is therefore possible to prevent the accuracy of determining an imbalance failure from dropping due to a variation in the operational state parameter.

It is preferable that the air-fuel ratio control apparatus according to the aspect further includes an air-fuel ratio variation unit that varies the air-fuel ratio at a set frequency (f1), and the specific frequency component is a component of the set frequency (frequency f1 component), wherein the failure determination unit determines a deterioration-originated failure in the air-fuel ratio detection unit based on the component of the set frequency.

According to this configuration, air-fuel ratio control of changing the air-fuel ratio at the set frequency is executed, and a deterioration-originated failure in the air-fuel ratio detection unit is determined based on the set frequency component. It is therefore possible to prevent the accuracy of determining a deterioration-originated failure in the air-fuel ratio detection unit from dropping due to a variation in the operational state parameter.

Obviously, numerous modifications and variations of the present invention are possible in light of the above teachings. It is therefore to be understood that within the scope of the appended claims, the invention may be practiced otherwise than as specifically described herein.

What is claimed is:

1. An air-fuel ratio control apparatus for an internal combustion engine, comprising:

an air-fuel ratio detector configured to detect an air-fuel ratio in an exhaust passage provided in the internal combustion engine including a plurality of cylinders;

a fuel amount controller configured to control an amount of fuel to be supplied to each of the plurality of cylinders;

an operational state parameter acquiring device configured to acquire at least one operational state parameter representing an operational state of the internal combustion engine;

an extractor configured to extract a specific frequency component from a detection signal output from the air-fuel ratio detector during a failure determination period;

a failure determination device configured to execute failure determination of determining a failure in an air-fuel ratio control system of the internal combustion engine based on the specific frequency component extracted by the extractor;

a variation state parameter calculator configured to calculate a variation state parameter representing a state of a variation in the operational state parameter after initiation of the failure determination period, the variation state parameter reflecting a variational history of the operational state parameter; and a determination stopping device configured to stop the failure determination if the variation state parameter calculated by the variation state parameter calculator is equal to or larger than a predetermined threshold value.

2. The air-fuel ratio control apparatus according to claim 1, wherein the determination stopping device is configured to stop the failure determination upon detection of a specific variation state where the variation state parameter is equal to or larger than the predetermined threshold value, the specific variation state influencing an intensity of the specific frequency component extracted by the extractor.

3. The air-fuel ratio control apparatus according to claim 2, wherein the variation state parameter calculator calculates the variation state parameter if the operational state parameter acquired by the operational state parameter acquiring device or an average value of the operational state parameter acquired by the operational state parameter acquiring device is within a range of predetermined upper and lower limits after initiation of the failure determination period.

4. The air-fuel ratio control apparatus according to claim 3, wherein the variation state parameter calculator is configured to calculate the variation state parameter by integrating an absolute value of a change in the operational state parameter after initiation of the failure determination period.

5. The air-fuel ratio control apparatus according to claim 4, wherein the specific frequency component is a 0.5th-order frequency component which is a frequency component equivalent to a half of a frequency corresponding to an engine speed of the internal combustion engine, and the failure determination device is configured to determine an imbalance failure such that an air-fuel ratio corresponding to each of the plurality of cylinders varies beyond an allowable limit, based on the 0.5th-order frequency component.

6. The air-fuel ratio control apparatus according to claim 3, wherein the variation state parameter calculator is configured to calculate an increase integrated value as the variation state parameter by integrating a positive amount of change in the operational state parameter after initiation of the failure determination period, and is configured to calculate a decrease integrated value as the variation state parameter by integrating a negative amount of change in the operational state parameter after initiation of the failure determination period, and the determination stopping device stops the failure determination if at least one of the increase integrated value and the decrease integrated value is equal to or larger than the predetermined threshold value.

7. The air-fuel ratio control apparatus according to claim 4, further comprising:

an air-fuel ratio variation device configured to vary the air-fuel ratio at a set frequency, wherein the specific frequency component comprises a component of the set frequency, and wherein the failure determination device is configured to determine a deterioration-originated failure in the air-fuel ratio detector based on the component of the set frequency.

8. The air-fuel ratio control apparatus according to claim 3, wherein the variation state parameter calculator is configured to update a maximum value and a minimum value of the operational state parameter after initiation of the failure determination period, and is configured to calculate a difference between the maximum value and the minimum value as the variation state parameter.

9. The air-fuel ratio control apparatus according to claim 3, wherein the variation state parameter calculator is configured to execute a band-pass filtering process to extract a predetermined frequency component included in the operational state parameter after initiation of the failure determination period, and is configured to calculate an operational state parameter subjected to the band-pass filtering process as the variation state parameter.

10. The air-fuel ratio control apparatus according to claim 2, wherein the operational state parameter acquiring device is configured to acquire a first operational state parameter and a second operational state parameter different from the first operational state parameter, and the variation state parameter calculator calculates the variation state parameter using the first operational state parameter if the second operational state parameter or an average value of the second operational state parameter is within a range of predetermined upper and lower limits after initiation of the failure determination period.

11. The air-fuel ratio control apparatus according to claim 10, wherein the variation state parameter calculator is configured to calculate the variation state parameter by integrating an absolute value of a change in the operational state parameter after initiation of the failure determination period.

12. The air-fuel ratio control apparatus according to claim 10, wherein the variation state parameter calculator is configured to calculate an increase integrated value as the variation state parameter by integrating a positive amount of change in the operational state parameter after initiation of the failure determination period, and is configured to calculate a decrease integrated value as the variation state parameter by integrating a negative amount of change in the operational state parameter after initiation of the failure determination period, and the determination stopping device stops the failure determination if at least one of the increase integrated value and the decrease integrated value is equal to or larger than the predetermined threshold value.

13. The air-fuel ratio control apparatus according to claim 10, wherein the variation state parameter calculator is configured to update a maximum value and a minimum value of the operational state parameter after initiation of the failure determination period, and is configured to calculate a difference between the maximum value and the minimum value as the variation state parameter.

14. The air-fuel ratio control apparatus according to claim 10, wherein the variation state parameter calculator is configured to execute a band-pass filtering process to extract a predetermined frequency component included in the operational state parameter after initiation of the failure determination period, and is configured to calculate an operational state parameter subjected to the band-pass filtering process as the variation state parameter.

15. The air-fuel ratio control apparatus according to claim 2, wherein the variation state parameter calculator is configured to calculate the variation state parameter by integrating an absolute value of a change in the operational state parameter after initiation of the failure determination period.

16. The air-fuel ratio control apparatus according to claim 2, wherein the variation state parameter calculator is configured to calculate an increase integrated value as the variation state parameter by integrating a positive amount of change in the operational state parameter after initiation of the failure determination period, and is configured to calculate a decrease integrated value as the variation state parameter by integrating a negative amount of change in the operational state parameter after initiation of the failure determination period, and the determination stopping device stops the failure determination if at least one of the increase integrated value and the decrease integrated value is equal to or larger than the predetermined threshold value.

17. The air-fuel ratio control apparatus according to claim 2, wherein the variation state parameter calculator is configured to update a maximum value and a minimum value of the operational state parameter after initiation of the failure determination period, and is configured to calculate a difference between the maximum value and the minimum value as the variation state parameter.

18. The air-fuel ratio control apparatus according to claim 2, wherein the variation state parameter calculator is configured to execute a band-pass filtering process to extract a predetermined frequency component included in the operational state parameter after initiation of the failure determination period, and is configured to calculate an operational state parameter subjected to the band-pass filtering process as the variation state parameter.

19. The air-fuel ratio control apparatus according to claim 2, wherein the specific frequency component is a 0.5th-order frequency component which is a frequency component equivalent to a half of a frequency corresponding to an engine speed of the internal combustion engine, and the failure determination device is configured to determine an imbalance failure such that an air-fuel ratio corresponding to each of the plurality of cylinders varies beyond an allowable limit, based on the 0.5th-order frequency component.

20. The air-fuel ratio control apparatus according to claim 2, further comprising:

an air-fuel ratio variation device configured to vary the air-fuel ratio at a set frequency, wherein the specific frequency component comprises a component of the set frequency, and wherein the failure determination device is configured to determine a deterioration-originated failure in the air-fuel ratio detector based on the component of the set frequency.

* * * * *